US006518922B1

(12) United States Patent
Hoffmeister

(10) Patent No.: US 6,518,922 B1
(45) Date of Patent: Feb. 11, 2003

(54) ANTENNA ARRANGEMENT AND RADIO DEVICE

(75) Inventor: Markus Hoffmeister, Salzgitter (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/700,898

(22) PCT Filed: Jan. 27, 1999

(86) PCT No.: PCT/DE99/00199

§ 371 (c)(1),
(2), (4) Date: Feb. 15, 2001

(87) PCT Pub. No.: WO99/60662

PCT Pub. Date: Nov. 25, 1999

(30) Foreign Application Priority Data

May 19, 1998 (DE) ..... 198 22 371

(51) Int. Cl.[7] ..... H01Q 1/38
(52) U.S. Cl. ..... 343/700 MS; 343/906
(58) Field of Search ..... 343/700 MS, 702, 343/745, 906, 820, 821, 822, 830, 860; H01Q 1/38

(56) References Cited

U.S. PATENT DOCUMENTS 5,061,939 A * 10/1991 Nakase ..... 343/700 MS
5,148,181 A * 9/1992 Yokoyama et al. ..... 343/702
5,568,155 A * 10/1996 Tsunekawa et al. .. 343/700 MS
5,767,810 A * 6/1998 Hagiwara et al. .... 343/700 MS
5,914,691 A * 6/1999 Mandai et al. ..... 343/728
5,917,450 A * 6/1999 Tsunekawa et al. .. 343/700 MS
5,966,097 A * 10/1999 Fukasawa et al. ... 343/700 MS
6,034,636 A * 3/2000 Saitoh ..... 343/700 MS
6,204,819 B1 * 3/2001 Hayes et al. ..... 343/702
6,218,991 B1 * 4/2001 Sanad ..... 343/700 MS
6,255,994 B1 * 7/2001 Saito ..... 343/700 MS
6,344,823 B1 * 2/2002 Deng

FOREIGN PATENT DOCUMENTS

| | | |
|---|---|---|
| EP | 0 630 069 | 12/1994 |
| EP | 0 642 189 | 3/1995 |
| EP | 0 687 030 | 12/1995 |
| JP | 62 279704 | 12/1987 |

OTHER PUBLICATIONS

Sanchez–Hernandez, D. et al., "A Survey of Broadband Microstrip Patch Antennas," Microwave Journal, vol. 39, No. 9, Sep. 1996, pp. 60, 62, 64, 66.*
Maci, S. et al., "Dual–Frequecy Patch Antennas", IEEE Antennas and Propagation Magazine, vol. 39, No. 6, Dec. 1997, pp. 13–15.*

* cited by examiner

*Primary Examiner*—Don Wong
*Assistant Examiner*—Trinh Vo Dinh
(74) *Attorney, Agent, or Firm*—Kenyon & Kenyon

(57) ABSTRACT

An antenna arrangement (1) is described that can be operated in two different operating frequency ranges. The antenna arrangement includes a radiating element that contains a supply connection and a reference potential connection. The radiating element is resonant in a first operating frequency range and a second operating frequency range that is different from the first and can be supplied via a supply connection using signals either in the first operating frequency range or the second operating frequency range. The reference potential connection is connected via a first impedance to a reference potential of a reference potential surface. The first impedance has a high resistance in a first operating frequency range and has low resistance in the second operating frequency range. In addition, a radio set is described that includes the antenna arrangement.

14 Claims, 2 Drawing Sheets

ANTENNA ARRANGEMENT AND RADIO DEVICE

FIELD OF THE INVENTION

The present invention relates to an antenna arrangement according to and a radio set.

The publication, "IEEE Transactions on Antennas and Propagation," Vol. 45, No. 10, October 1997, describes a dual-frequency planar inverted-F antenna, which contains a radiating element, a plurality of reference potential connections, and a supply connection. The radiating element is resonant in a first operating frequency range at roughly 1.8 GHz and in a second operating frequency range, different from the first operating frequency range, at roughly 0.9 GHz. In this context, the radiating element is supplied with signals via the supply connection either in the first operating frequency range or in the second operating frequency range.

SUMMARY

In contrast, the antenna arrangement according to the present invention has the advantage that the reference potential connection is connected to the reference potential of a reference potential surface via a first impendance that, has a high resistance in the first operating frequency range and low resistance in the second operating frequency range. By terminating the reference potential connection in a frequency-selective manner, the radiating element, and the antenna arrangement, is resonant in both the first operating frequency range and the second operating frequency range, and radiates effectively. In the radiating element, no precautions are necessary such as an L-shaped incision for creating two partial radiating elements, thus the effort involved in manufacturing the antenna arrangement and the costs related thereto can be kept low.

It is particularly advantageous that the first impedance is configured as a line whose length is selected such that the line impedance has low resistance in the second operating frequency range and high resistance in the first operating frequency range. The second operating frequency range has frequencies that are roughly half as large as the frequencies of the first operating frequency range. This represents a particularly simple realization of the frequency-selective termination of the reference potential connection of the antenna arrangement.

It is advantageous if the length of the line corresponds to roughly one fourth of the operating wavelength of the second operating frequency range, and if the line runs in open circuit. In this manner, for the second operating frequency range, the line constitutes a short-circuit and, for the first operating frequency range, it constitutes an open circuit between the reference potential connection and the reference potential. Thus the necessary low-resistance or high-resistance first impedance can be produced simply and in a space-saving manner.

The same advantage is gained by using, for the first impedance, a resonant circuit whose resonance frequency lies roughly within the second operating frequency range. The resonant circuit therefore represents a particularly low-resistance impedance in the second operating frequency range and has a high resistance for frequencies of the first operating frequency range.

A further advantage is that the first impedance is configured as a semiconductor component, for example a PIN diode. In this way, the first impedance does not depend on the frequencies of the two selected operating frequency ranges, and the antenna can be switched electronically between its operating frequencies.

A further advantage is that the length of the radiating element, the height of the supply connection and of the reference potential connection of the antenna arrangement, and the distance between the supply connection and the reference potential connection are determined such that the input resistance of the antenna arrangement at the supply connection is roughly the same for both operating frequency ranges. In this manner, the input resistance of the antenna arrangement, in a simple manner on the basis of the corresponding geometric dimensioning of the antenna arrangement, for both operating frequency ranges without impedance transformation, can be linked to an antenna network for the supply and reception of radio signals, so that savings are achieved with respect to components, space, and cost.

A further advantage is that a second impedance is provided that transforms an output resistance of an antenna network such that it is adjusted in both operating frequency ranges to the respective input resistance of the antenna arrangement at the supply connection. In this manner, an impedance adjustment between the output resistance of the antenna network and the input resistance of the antenna arrangement at the supply connection can be realized irrespective of the geometry of the antenna arrangement, so that the geometric dimensions of the antenna arrangement are not subject to fixed requirements and the antenna arrangement can be adjusted to spatial circumstances or limitations.

A further advantage is that the second impedance is configured as a line whose length corresponds to one fourth of the operating wavelength of the second operating frequency range. The second operating frequency range having frequencies that are roughly half as large as the frequencies of the first operating frequency range. In this manner, the second impedance can be realized in a particularly simple and cost-effective manner.

A further advantage is that the radiating element is bent. In this manner, the antenna arrangement can be reduced in size and space can be saved without reducing the effectiveness of the antenna.

A further advantage is that the antenna arrangement is embedded in a material whose dielectric constant is significantly larger than 1. In this manner, both a reduction in size of the antenna, and thus space savings, can be achieved without significantly reducing the effectiveness of the antenna.

It is advantageous to use an antenna arrangement according to the present invention in a radio set. A radio set of this type can be operated in a simple, inexpensive, cost- and space-saving manner in two different operating frequency ranges without reducing the effectiveness of the antenna in the two operating frequency ranges.

DETAILED DESCRIPTION

Figure 1:
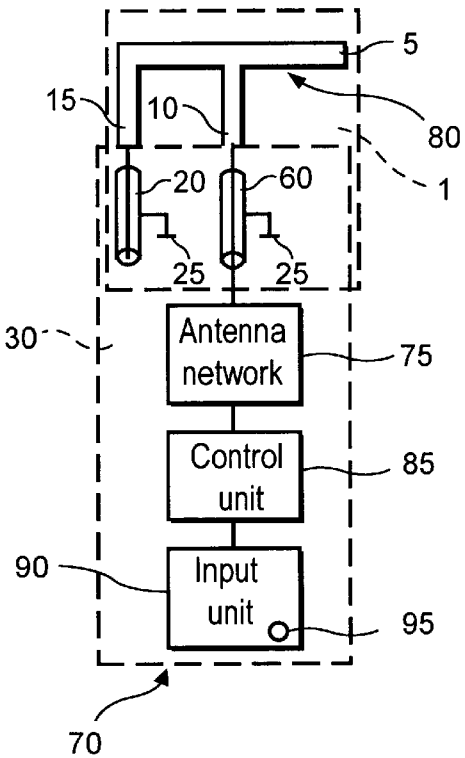
FIG. 1 shows a first embodiment of a radio set that has an antenna arrangement according to the present invention.

In FIG. 1, 70 indicates a radio set, which can be configured, for example, as a mobile or cordless telephone, a hand set, a service radio set, or the like. Radio set 70 includes a printed circuit board, which has a reference potential surface 30 that has a reference potential 25. Reference potential surface 30, in this context, can extend partially, or as in FIG. 1, completely over the printed circuit board. Radio set 1 also includes an antenna arrangement 1 that has a radiating element 5, which includes, perpendicular to radiating element 5, a supply connection 10 and a reference potential connection 15, which one roughly the same length. In this context, reference potential connection 15 is arranged at one end of radiating element 5 its other end free. Supply connection 10 is arranged in the center of radiating element 5 and reference potential connection 15. Supply connection 10 can also be arranged between the center of radiating element 5 and reference potential connection 15. Antenna arrangement 1, in this context, is resonant in a first operating frequency range of, for example, roughly 1.8–1.9 GHz and in a second operating frequency range, different from the first, of, for example, roughly 0.9–1.0 GHz, and it can be supplied via a supply connection 10 with signals either in the first operating frequency range or in the second operating frequency range. Antenna 80, which is made up of radiating element 5, supply connection 10, and reference potential connection 15, is configured in an F-shape, the two crossbeams functioning as supply connection 10 and reference potential connection 15, and connecting antenna 80 an antenna network 75 and reference potential 25, respectively, so that an F standing on its head is the resulting geometric form of antenna 80. The two crossbeams are constituents of antenna 80. Antenna 80 therefore is designated as an inverted-F antenna and, due to its functionality in two different operating frequency ranges, as a Dual-Frequency Inverted-F Antenna (DF-IFA). Antenna 80, in this context, is arranged over reference potential surface 30, which constitutes the antenna counterweight.

Reference potential connection 15 is connected, via a first impedance configured as first line 20, to reference potential 25 of reference potential surface 30. The length of first line 20, in this context, is determined such that the impedance of first line 20 has low resistance in the second operating frequency range and high resistance in the first operating frequency range. The second operating frequency range contain frequencies that are roughly half as large as the frequencies of the first operating frequency range. The length of first line 20, in this context, can correspond to roughly one fourth of the operating wavelengths of the second operating frequency range, when the line is in open-circuit operation. In this manner, a varying low-resistance connection of reference potential connection 15 to reference potential 25 is generated for the frequencies of the second operating frequency range. For the frequencies of the first operating frequency range, a very high-resistance connection of reference potential connection 15 to reference potential 25 results, because for these frequencies the length of first line 20 roughly corresponds to one half of the associated operating wavelengths, the wavelength associated to one frequency resulting from the inverse of the frequency, multiplied by the speed of light. As result of the described frequency-selective termination of reference potential connection 15 by first line 20, antenna 80 is resonant both in the first and in the second operating frequency range, and has good radiating properties.

First line 20, in this context, is configured, for example, as a strip line, a microstrip line, or a coaxial line, whose inner conductor is connected to reference potential connection 15 and whose outer conductor is connected to reference potential 25.

Supply connection 10 is connected, via a second impedance configured as second line 60, to an antenna network 75, to which a control unit 85 is connected. Control unit 85 is also connected to an input unit 90, which has an operating control element 95. Second line 60 can also be configured, for example as a strip line, a microstrip line, or a coaxial line, whose inner conductor is connected to supply connection 10 to, to antenna network 75, and whose outer conductor is connected to reference potential 25. Second line 60 transforms an output resistance of antenna network 75 so that the latter is adjusted, in both operating frequency ranges, to the respective input resistance of antenna arrangement 1 at supply connection 10. The input resistance of antenna arrangement 1 at supply connection 10, in this context, is a function of the operating frequency employed and of the geometry of antenna 80. The length of second line 60 also corresponds roughly to one fourth of the operating wavelengths of the second operating frequency range. In the event that the output resistance of antenna network 75 is 50 Ω and the input resistance of antenna arrangement 1 at supply connection 10 amounts to 30 Ω in the second operating frequency range, the result, for the wave impedance of second line 60 of $\sqrt{30*50}\Omega$ in the second operating frequency range is an adjustment of the output resistance of antenna network 75 to the input resistance of antenna arrangement 1 at supply connection 10 in the second operating frequency range. In the first operating frequency range, the input resistance of antenna arrangement 1 at supply connection 10 amounts to 50 Ω. Because the length of second line 60 in the first operating frequency range corresponds to one half of the operating wavelengths of the first operating frequency range, the output resistance of antenna network 75 of 50 Ω in the first operating frequency range is reflected onto itself by second line 60 and is also adjusted to the input resistance of antenna arrangement 1 at supply connection 10 in the first operating frequency range.

The geometric dimensions of antenna 80, in this context, should be selected such that in the first operating frequency range the input resistance of antenna arrangement 1 at supply connection 10 is 50 Ω and, in the second operating frequency range, is 30 Ω.

Figure 2:
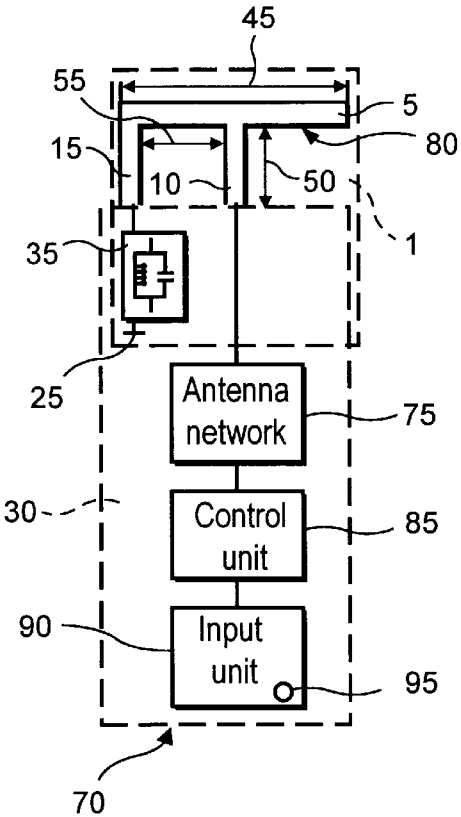
FIG. 2 shows a second embodiment of a radio set that has an antenna arrangement according to the present invention.

According to a further embodiment shown in, FIG. 2, first line 20 is replaced by a resonant circuit 35, whose resonance frequency lies roughly within the second operating frequency range, so that in the second operating frequency range the resonant circuit connects reference potential connection 15 in a low-resistance manner to reference potential 25. For, frequencies of the first operating frequency range, resonant circuit 35 connects reference potential connection 15 in a high-resistance manner to reference potential 25. As a result of this type of frequency-selective termination of reference potential connection 15 by resonant circuit 35, it is also radiating element 5, and therefore antenna 80, is resonant both in the first and the second operating frequency range, and has good radiating properties. In contrast to the embodiment according to FIG. 1, in the embodiment according to FIG. 2, antenna network 75 is directly connected to supply connection 10 of antenna 80. In this context, length 45 of radiating element 5, height 50 of supply connection 10 and of reference potential connection 15, and distance 55 between supply connection 10 and reference potential connection 15 are determined such that the input resistance of antenna arrangement 1 at supply connection 10 is roughly the same for both operating frequency ranges. For example, length 45 of radiating element 5 roughly is 80 mm, height 50 of supply connection 10 and of reference potential connection 15 roughly are each 15 mm, and distance 55 between supply connection 10 and reference potential connection 15 roughly is 15 mm, so that in both the first operating frequency range, for example between 1.8 GHz and 1.9 GHz, and the second operating frequency range, for example between 0.9 GHz and 1 GHz, the input resistance of antenna arrangement 1 at supply connection 10 is in each case 50 Ω. In this context, the first operating frequency range between 1.8 GHz and 1.9 GHz is used, for example, in the e-network in Germany for mobile radio and, according to the DECT standard (Digital Enhanced Cordless Telecommunications), for cordless telephone systems. Since the input resistance of antenna arrangement 1 at supply connection 10 is roughly the same for both operating frequency ranges and, like output resistance of antenna network 75, is 50 Ω, an impedance transformation between antenna network 75 and supply connection 10 is not necessary. Regardless of the differences described, radio set 70 according to the embodiment in FIG. 2 is constructed so as to be identical to radio set 70 according to the embodiment in FIG. 1.

Figure 3:
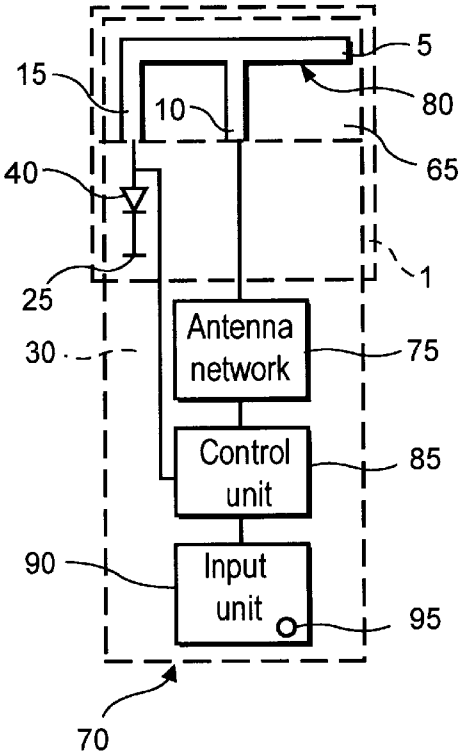
FIG. 3 shows a third embodiment of a radio set that has an antenna arrangement according to the present invention.

In a further embodiment, according to FIG. 3, the same geometric dimensions are used for antenna 80 as in the embodiment according to FIG. 2, so that between antenna network 75 and supply connection 10, once again no impedance transformation is required. In contrast to the embodiment according to FIG. 2, in the embodiment according to FIG. 3, resonant circuit 35 is replaced by a PIN diode 40, whose anode is connected to reference potential connection 15 and whose cathode is connected to reference potential 25. A further difference with respect to the embodiment shown in FIG. 2 is that according to FIG. 3, control unit 85 drives the anode of PIN diode 40 and antenna 80 is embedded in a material 65 whose dielectric constant is significantly larger than 1. In place of PIN diode 40, a different semiconductor element can be used, for example, a conventional pn diode or a transistor, which are driven accordingly by control unit 85. In this context, PIN diode 40 is switched into a blocking state by a low-level control signal from control unit 85 when radiating element 5 is supplied via supply connection 10 with signals whose frequency lies in the first operating frequency range, so that in the first operating frequency range a high-resistance connection exists between reference potential connection 15 and reference potential 25. PIN diode 40 is switched into a conductive state by a high-level control signal from control unit 85, when radiating element 5 is supplied via supply connection 10 with signals whose frequency lies in the second operating frequency range, so that in the second operating frequency range, reference potential connection 15 is connected in a low-resistance manner to reference potential 25.

In this way as well, a frequency-selective termination of reference potential connection 15 results from PIN diode 40, so that antenna 80 is resonant both in the first and the second operating frequency range, and has good radiating properties.

By using material 65 having a dielectric constant that is significantly larger than 1, the geometric dimensions of antenna 80 can be reduced in size at a minor reduction in antenna effectiveness.

Figure 4:
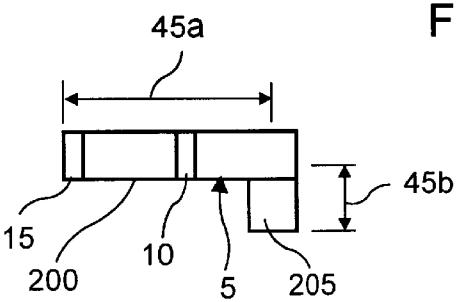
FIG. 4 shows a bent radiating element according to the present invention.

A further reduction in the size of antenna 80 results from bending radiating element 5 in accordance with FIG. 4 at the free end of radiating element 5. The length of radiating element 5, in this context, is measured as the sum of length 45*b* of bent part 205 of radiating element 5 and length 45*a* of unbent part 200 of radiating element 5. In this context, the bend is configured so as to be roughly at a right-angle bent part 205 being able to point in any direction. A advantageous embodiment, in this context, results from a downwards bend, bent part 205 being arranged roughly parallel to supply connection 10 and to reference potential connection 15 in the direction of radio set 70. However, the bend can also be provided so as to be perpendicular to supply connection 10 and to reference potential connection 15, bent part 205 and unbent part 200 being roughly in the same plane, as is depicted in FIG. 4.

Figure 5:
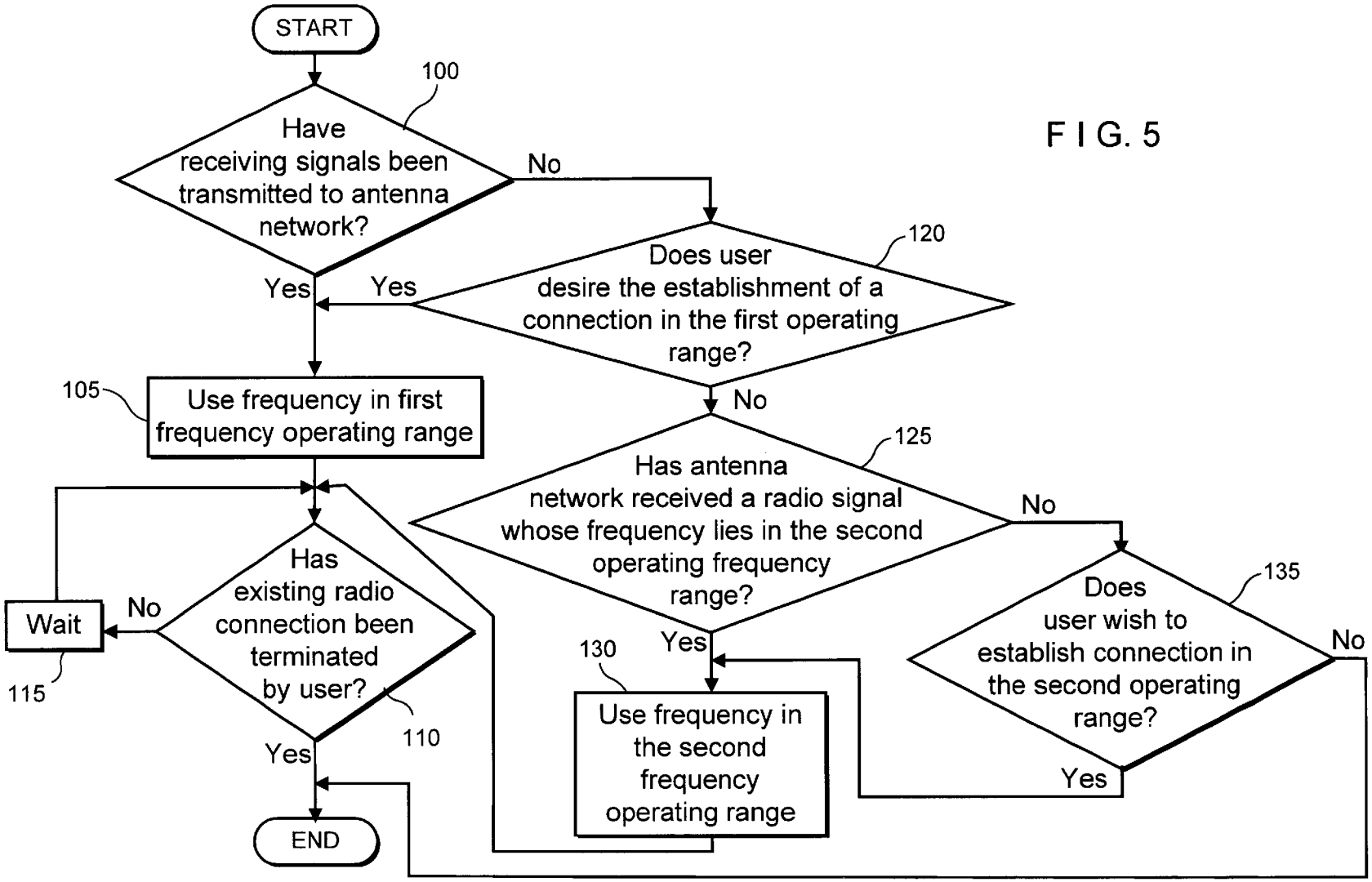
FIG. 5 shows a flowchart for a control unit of a radio set according to the present invention.

FIG. 5 depicts a flowchart for the mode of operation of control unit 85 of radio set 70. At one program point 100, control unit 85 checks whether receiving signals have been transmitted to antenna network 75 via antenna 80, which also operates as a receiving antenna, and via supply connection 10. The frequency of the receiving signals lies in the first operating frequency range. If this is the case, then a branch is taken to program point 105, and if not, then to program point 120. At program point 105, control unit 85 causes antenna network 75 to use a frequency in the first operating frequency range for the transmission of signals via antenna 80, after supplying them via supply connection 10. In this context, in antenna arrangement 1 according to FIG. 3, PIN diode 40 is driven in a low-level fashion by control unit 85 so that reference potential connection 15 is connected in a high-resistance manner to reference potential 25. Subsequently, the branching is taken to program point 110. At program point 110, control unit 85 checks whether the existing radio connection has been terminated by the user, for example, via input unit 90. If this is the case, then the program part is exited; if not, then the branching is taken to program point 115. At program point 115, a wait loop is run through. Subsequently, the branching is taken back to program point 110. At program point 120, control unit 85 checks whether the user through a corresponding actuation of operating element 95 desires the establishment of a connection in the first operating frequency range. If this is the case, then the branching is taken to program point 105, and if not, then to program point 125. At program point 125, the control unit 85 checks whether antenna 80 in antenna network 75 has received a radio signal whose frequency lies in the second operating frequency range. If this is the case, then the branch is taken to program point 130, and if not, then to program point 135. At program point 130, control unit 85 causes antenna network 75 to use a frequency in the second operating frequency range for the transmission of signals via antenna 80. In addition, control unit 85 in this case, according to the embodiment in FIG. 3, controls PIN diode 40 using a high-level control signal, so that PIN diode 40 is switched into the conductive state, and it connects reference potential connection 15 in a low-resistance manner to reference potential 25. Subsequently, the branching is taken to program point 110. At program point 135, control unit 85 checks whether the user through a corresponding actuation of operating element 95 wishes to establish a connection in the second operating frequency range. If this is the case, then the branching is taken to program point 130, and if not, then the program part is exited.

Antenna 80 is well-suited for operation in two different operating frequency ranges. As a result of the small overall height of antenna 80, antenna 80 can be integrated, for example, in a handset housing or in a planar base station housing. Antenna arrangement 1 therefore is not limited to use with a radio set.

For reference potential surface 30 as the counterweight to antenna 80, according to the described embodiment, a length is chosen of, for example, 100–200 mm.

What is claimed is:

1. An antenna arrangement, comprising:

a radiating element having a supply connection and a reference potential connection, the radiating element being resonant in a first operating frequency range and a second operating frequency range, the second operating frequency range being different from the first operating frequency range, the radiating element being supplied signals via the supply connection, the signals being in one of the first operating frequency range and the second operating frequency range;

an electronic circuit having a first impedance, the first impedance having a high resistance in the first operating frequency range and a low resistance in the second operating frequency range; and a reference potential surface having a reference potential connected to the reference potential connection via the electronic circuit, wherein the electronic circuit is a semiconductor component which includes a PIN diode.

2. A radio set having antenna arrangement, the antenna arrangement including:

a radiating element having a supply connection and a reference potential connection, the radiating element being resonant in a first operating frequency range and a second operating frequency range, the second operating frequency range being different from the first operating frequency range, the radiating element being supplied signals via the supply connection, the signals being in one of the first operating frequency range and the second operating frequency range; and an electronic circuit having a first impedance, the first impedance having a high resistance in the first operating frequency range and a low resistance in the second operating frequency range; and a reference potential surface having a reference potential connected to the reference potential connection via the electronic circuit.

3. The radio set according to claim 2, wherein:

the radio set is one of a mobile radio and a cordless telephone.

4. An antenna arrangement, comprising:

a radiating element having a supply connection and a reference potential connection, the radiating element being resonant in a first operating frequency range and a second operating frequency range, the second operating frequency range being different from the first operating frequency range, the radiating element being supplied signals via the supply connection, the signals being in one of the first operating frequency range and the second operating frequency range; and an electronic circuit having a first impedance, the first impedance having a high resistance in the first operating frequency range and a low resistance in the second operating frequency range; and a reference potential surface having a reference potential connected to the reference potential connection via the electronic circuit.

5. The antenna arrangement according to claim 4, wherein:

the electronic circuit is a resonant circuit having a resonant frequency approximately within the second operating frequency range, the resonant circuit having a high resistance for frequencies of the first operating frequency range.

6. The antenna arrangement according to claim 4, wherein:

the electronic circuit is a semiconductor component.

7. The antenna arrangement according to claim 6, wherein:

the semiconductor is configured to be switched into a blocking state when the radiating element is supplied with signals having a frequency within the first operating frequency range; and the semiconductor is configured to be switched into a conductive state when the radiating element is supplied with signals having a frequency within the second operating frequency range.

8. The antenna arrangement according to claim 4, wherein:

a length of the radiating element, a height of the supply connection, a height of the reference potential connection, and a distance between the supply connection and the reference potential connection are configured so that an input resistance of the antenna arrangement at the supply connection is approximately the same for the first operating frequency range and the second operating frequency range.

9. The antenna arrangement according to claim 8, wherein:

the length of the radiating element is approximately 80 mm;

the height of the supply connection is approximately 15 mm;

the height of the reference potential connection is approximately 15 mm;

the distance between the supply connection and the reference potential connection is approximately 15 mm;

the first operating frequency range is 1.8 GHz to 1.9 GHz; and the second operating frequency range is 0.9 GHz to 1 GHZ, so that in the first operating frequency range and the second operating frequency range, the input resistance of the antenna arrangement at the supply connection is 50 ohms.

10. The antenna arrangement according to claim 4, further comprising:

a second impedance transforming an output resistance of an antenna network so that in the first operating frequency range and the second operating frequency range the output resistance is adjusted to a respective input resistance of the antenna arrangement at the supply connection.

11. The antenna arrangement according to claim 10, wherein:

the second impedance is a line impedance having a length approximately equal to one fourth of operating wavelengths of the second operating frequency range, the second operating frequency range having frequencies that are approximately half as large as frequencies of the first operating frequency range.

12. The antenna arrangement according to claim 4, wherein:

the radiating element is bent.

13. The antenna arrangement according to claim 4, wherein:

the antenna arrangement is embedded in a material having a dielectric constant significantly larger than one.

14. The antenna arrangement according to claim 4, wherein:

the radiating element, the supply connection, and the reference potential connection are an inverted-F antenna.

* * * * *

UNITED STATES PATENT AND TRADEMARK OFFICE

CERTIFICATE OF CORRECTION

PATENT NO. : 6,518,922 B1
DATED : February 11, 2003
INVENTOR(S) : Hoffmeister et al.

It is certified that error appears in the above-identified patent and that said Letters Patent is hereby corrected as shown below:

Title page,
Item [57], ABSTRACT,
Line 1, delete "(1)"

Column 1,
Line 8, delete "according to"
Line 9, insert -- BACKGROUND INFORMATION --

Column 2,
Line 34, change "having" to -- has --.

Column 3,
Line 12, change "one" to -- are --
Line 14, change "element 5 its" to -- element 5 with its --
Line 46, change "contain frequencies" to -- contains frequencies --

Column 4,
Line 5, change "configured as" to -- configured, for example, as --
Line 9, change "for example as a" to -- for example, as a --
Line 11, change "to, to antenna" to -- and antenna --
Line 55, change "circuit 35, it" to -- circuit 35, --
Line 56, change "is also radiating" to -- radiating --

Column 6,
Line 1, change "right-angle bent" to -- right-angle, bent --

Signed and Sealed this

Twenty-fifth Day of May, 2004

JON W. DUDAS
*Acting Director of the United States Patent and Trademark Office*